United States Patent [19]

Ward

[11] Patent Number: 4,708,189

[45] Date of Patent: Nov. 24, 1987

[54] SCREEN

[76] Inventor: Alec D. Ward, 23 Saxton Road, Pakefield, Lowestoft, Suffolk, England

[21] Appl. No.: 824,423

[22] Filed: Jan. 31, 1986

[30] Foreign Application Priority Data

| | | | |
|---|---|---|---|
| Feb. 5, 1985 | [GB] | United Kingdom | 8502821 |
| Mar. 11, 1985 | [GB] | United Kingdom | 8506205 |
| Jun. 13, 1985 | [GB] | United Kingdom | 8514963 |
| Sep. 6, 1985 | [GB] | United Kingdom | 8522206 |

[51] Int. Cl.[4] ..... A47G 5/00

[52] U.S. Cl. ..... 160/351; 160/330

[58] Field of Search ..... 160/351, 382, 24, 352, 160/330, 354, 368 R, 327; 211/180, 105.6, 105.5

[56] References Cited

U.S. PATENT DOCUMENTS

| | | | |
|---|---|---|---|
| 2,005,134 | 6/1935 | Emley | 160/351 |
| 2,353,625 | 7/1944 | Moore | 160/351 X |
| 2,611,427 | 9/1952 | DuMais et al. | 160/351 X |
| 2,991,040 | 7/1961 | Levy | 211/105.6 X |
| 3,062,381 | 11/1962 | Maiden | 211/105.6 |
| 3,118,363 | 1/1964 | Burgess | 160/330 |
| 4,228,980 | 10/1980 | Beauchamp et al. | 160/330 X |

*Primary Examiner*—Robert W. Gibson, Jr.
*Attorney, Agent, or Firm*—Kane, Dalsimer, Kane, Sullivan and Kurucz

[57] ABSTRACT

A screen for extending between two surfaces, for example, a floor and a ceiling, the screen comprising a sheet of flexible material, pairs of optionally interengageable battens and support means, the support means being biased to urge the pairs of battens against the surface retaining the sheet extended between them. If the battens are engaged, they may be pivotable about the means engaging them.

18 Claims, 13 Drawing Figures

SCREEN

This invention relates to a screen, and more especially to a portable floor to ceiling screen.

Floor to ceiling screens as used in the building and asbestos removal industry have until now been constructed on site using wood battens and polyethylene sheeting.

Screens of this nature are however relatively expensive because of the need for skilled labour in their construction and the time involved therein.

The present invention provides a screen extending between first and second spaced apart surfaces and comprising a sheet of flexible material, at least one pair of rails and at least one support means positioned between the or each pair of rails and maintaining them apart, the sheet of flexible material extending between the surfaces with a first portion of the sheet being retained between the first surface and one rail and a second portion of the sheet being retained between the second surface and the other rail of the or each pair of rails.

The first and second portions of the sheet are conveniently and preferably edge regions, though they need not be, and will normally not both be when the sheet is of greater length than the distance between the surfaces and it is desired that the sheet be maintained in a taut condition. Advantageously the support means urges, and preferably resiliently urges, the rails apart and hence toward the surfaces, more securely to retain the sheet between the rails and the surfaces.

In a preferred embodiment, there are provided at least two pairs of rails, with at least one support means being positioned between each pair of rails and maintaining, advantageously urging, and preferably resiliently urging them apart.

The rails at the opposite ends of a support means are referred to herein as a pair of rails, while rails at one surface constitute a set.

Advantageously, members, preferably all the members, of the set of rails retaining the sheet between them and at least one surface are interengaged; preferably, the rails retaining the sheet between them and each surface are interengaged.

Preferably, as indicated above, each support means urges, preferably resiliently, pairs of rails apart, and toward the opposed surfaces. In a presently less preferred embodiment, the support means may maintain or urge one rail or set of rails at or toward one surface only, the support means acting directly on the sheet at the opposed surface to maintain it at or urge it toward that surface.

The present invention accordingly also provides a screen extending between spaced apart surfaces and comprising a sheet of flexible material, at least two, preferably interengaged, rails and at least two support means each maintaining a rail at or urging it toward a surface, the sheet of flexible material extending between the surfaces with a first portion of the sheet being retained between a first surface and the rails and a second portion of the sheet being retained between a second surface and the support means.

The invention also provides a kit of parts that may be assembled to provide a screen according to the invention, and a method of assembling and installing such a screen. The invention further provides a sheet suitable for use in the screen.

More especially, the method of installing the screen comprises positioning an edge region of the flexible sheet between a first rail or rails, preferably interengaging rails, and a first surface, advantageously the upper edge being positioned against a ceiling, positioning support means to engage the rail or rails and a second surface and causing or allowing the support means to press the rail or rails toward the first surface to engage the edge region between the rail or rails and the first surface, disengaging the support means from the second surface, positioning a second edge region of the sheet and, if desired, a rail, optionally and preferably interengaging second rails, between the second surface and the support means, with the second rail or rails, if present, between the support means and the edge region, and causing or allowing the support means to press the second rail or rails if present toward the second surface to engage the sheet between the rail or rails and the second surface, or if no second rail is or rails are present causing or allowing the support means to secure the sheet between it and the second surface. Preferably, if there are two or more rails corresponding to the first surface they are all installed before any rail corresponding to the second surface is installed if present.

Advantageously one edge region of the sheet is formed into a rail-receiving tube, as by welding if the sheet is of a plastics material, which is preferred, or by sewing if the sheet is of a textile material, with apertures spaced apart along the length of the tube through which the support means may pass. The weld or seam may be substantially continuous, in which case the apertures will be formed elsewhere in the portion of the sheet that forms the tube. Alternatively, the weld or seam may be discontinuous, but still preferably along a line parallel to the edge of the sheet, either as a broken line form of weld or seam or, which is preferred, in the form of spaced apart spot welds, the spots being of size and shape such as to delocalize any stress put upon the area.

It will be appreciated that part of the support means may be integral with or attached to a rail. The rail is advantageously a batten.

Although, as indicated above, one edge region, advantageously the upper edge region, of the sheet may be formed into a rail-receiving tube, this arrangement, though preferred, is not essential. Alternatively, or also, one or each edge region of the sheet may be retained between the specified rail and a further rail which will itself form the first or second surface, this in turn engaging the primary surface, e.g., the floor or ceiling, to which the screen is to extend. The two rails between which an edge region of the sheet is located may be interlocked so as to retain the sheet in a fixed position between them. The further rail may itself be capable of urging, preferably resiliently, the specified rail toward the opposed surface in which case the support means may act to maintain rather than urge the specified rails apart.

The support means advantageously comprises at least two members, advantageously elongate members to extend between the surfaces, and preferably tubular members, of which at least one advantageously has an end section of reduced or enlarged diameter, whereby the members may be telescopically engaged. The number and length of the members will be selected according to the space between the surfaces, e.g., the height between floor and ceiling.

Advantageously, the combined length of at least one pair of members of the support means may be varied, advantageously continuously, and means are provided whereby the said combined length may be maintained at a desired value. This may be achieved, in the case of a pair of telescopically engaging members, by a thumbscrew inserted through a threaded aperture in the outer member, the end of the screw engaging the outer surface of the inner member.

The support means may comprise means providing it with a bias toward extending its length. The means may comprise, for example, a compression spring positioned, for example, within the outer member of a pair of telescopically engaged members.

In one preferred embodiment, a biasing means, especially in the form of a compression spring, is mounted at its first end within the outer member and at its second end mounted to the inner member of a pair of telescopically engaged members, at least the first end being mounted at a region spaced from the end of the outer member, the second end also optionally being mounted to the inner member at a region spaced from the end of the inner member, and advantageously within the inner member. The arrangement is preferably such that the major proportion of the spring lies within the outer member between its point of attachment thereto and the end of the inner member. By this means, the telescopically engaged members may be retained as a unit including a captive spring.

In one preferred embodiment, the biasing means, in particular the spring, is located within a part of the support means that is integral with or attached to a rail. In another preferred embodiment, the support means may be retained in a rail that is in the form of, for example, a trough, especially a rectangular trough, by appropriately shaping the side walls, e.g., by deforming, for example, at the central region of the rail, at least the free ends of the walls of the trough to provide a zone in which an end of the support means is a force fit. This deformation may comprise, for example, forming in a given region of the rail a pair of spaced apart constrictions optionally separated by a region wider than in the remainder of the rail to ensure that an end of the support means is reliably located in the desired region of the rail, thereby reducing the danger of collapse of the screen through accidental displacement or mispositioning of a support means.

The rails may be caused to interengage at their ends, or at points along their lengths, so that, for example, the end of one rail may interengage another at an intermediate point. In an installed screen, most pairs of adjacent rails will be collinear, but at the end of the screen it may be desirable for a pair of adjacent rails to meet at an angle other than 180°, and advantageously the interengagement means provided is such as to allow the rails to interengage at a range of angles, advantageously at any angle between 90° and 180°.

Any form of interengagement means may be used that is appropriate to the construction of the rail. For example, if the rail is solid, e.g., a wooden rail, or has an upper surface, a longitudinal groove may be formed along the upper surface extending a short distance from each end of each rail, and a rod inserted in the collinear grooves of adjacent rails. If a non-linear join is required, a rod bent to the desired angle may be used. If the rail is hollow, for example, is in the form of a rectangular trough, vertical grooves may be formed in the upper portions of the side walls of the trough close to and at a first end, the second end of the rail having the lower portion of its end wall and part of its bottom wall omitted to allow it to be fitted into the grooves at the first end of a similar rail. In a second embodiment suitable for use with a rectangular trough profile, the upper portion of the end wall at a first end may be omitted, while at the second end the upper portion of the end wall is formed into a tongue which may be looped over a first end wall of a similar rail. In a further, presently preferred, embodiment, a horizontal slot is provided in the first end wall, similar slots preferably being provided in each side wall close to the first end, while the upper portion of the second end wall is formed into a tongue, of reduced width compared with the lower portion, for engagement in a slot.

In a further presently preferred embodiment, interengagement means are provided which allow some pivotal motion of the rails about the means on an axis perpendicular to the surface against which the rails are urged, e.g., the axis is vertical when the screen is vertical. This may be achieved by providing, for example, a slotted member, e.g., a slotted cup member, pivotally mounted at a first end of a rail, the member being arranged to pivot about a vertical axis when the screen is to be vertical, and a tongue on the second end of each rail, which engages the slot of a similar rail. Other means, for example, hooks and eyes, may of course be used.

By interengaging the ends of at least one set and if present preferably both sets of rails the stability of the installed screen is enhanced.

In a further embodiment, the rails may be generally tubular, advantageously of circular crosssection, each rail being provided with one or more portions of reduced cross-section, referred to for convenience as portions of reduced diameter. Such portions, which may be obtained by, for example, swaging, may be provided at one end only of each rail, to enable that end to engage the standard diameter end of a similar rail. One or more reduced diameter portions may also be provided between the ends of the rail, to facilitate proper location around the rail of an engagement means provided on a support member. The engagement means may be, for example, a resilient clip of part circular cross-section of diameter such that it may be located round the rail. Advantageously, its diameter is such that it may readily be located around a reduced diameter portion of the rail but is such as to be prevented by the shoulder between the reduced and standard diameter portions from sliding along the rail. The clip, which may be of, for example, a plastics material, may be fixedly mounted at an end of the support means. It may instead be mounted at the support means end on a biasing means, e.g., a short member provided with a compression spring as mentioned above.

By the present invention there is provided a screen that may be erected by unskilled labour. The telescopic members of the screen according to the preferred embodiment enable the screen to fit any floor to ceiling height between, for example, 2 meters and 4 meters. The spring loaded support members upon which the sheet preferably hangs enable the screen to be made rigid without the need for extra mechanical fixing. The tube with openings at the upper edge of the sheet enables the sheet to hang upon the support members without the need for other mechanical fixings such as screws, nails or staples, and the ability of the screen to be dismantled, packed into a portable container, carried to another site and be re-erected without recourse to any structural alterations is highly advantageous.

Various forms of screen constructed in accordance with the invention will now be described by way of example only with reference to the accompanying drawings in which:

Figure 1:
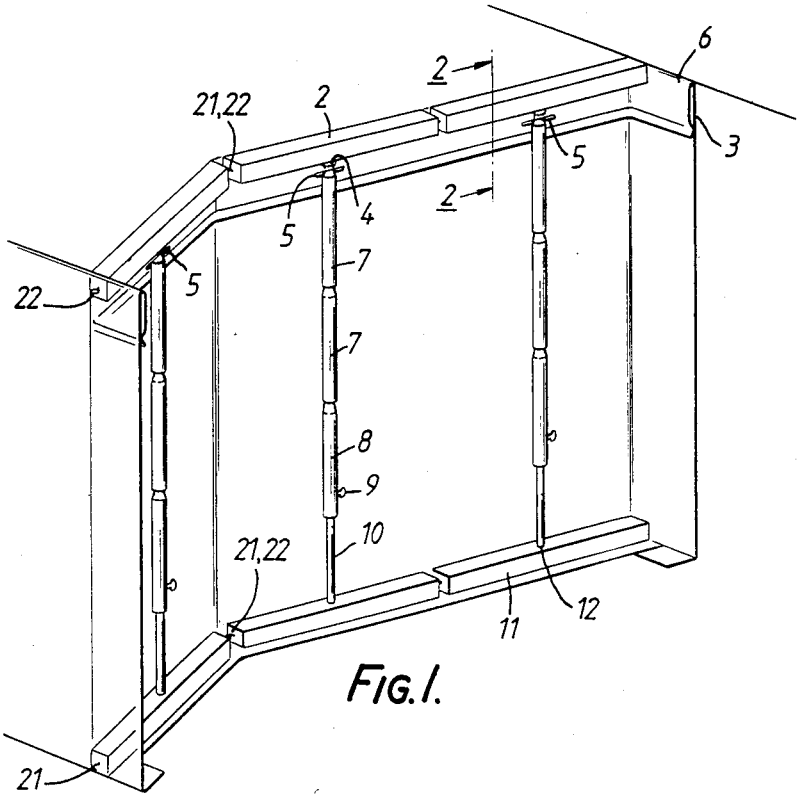
FIG. 1 shows one form of screen in position within a room.
Figure 2:
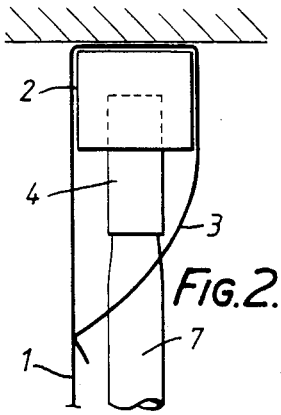
FIG. 2 is a vertical section along the line 2—2 through the upper portion of the screen.

Referring now to the drawings, and more especially to FIGS. 1 to 4, the screen comprises a sheet 1 of flexible material which is supported on a collapsible support means which butts between floor and ceiling.

In order to assemble the screen the sheet 1 provided at its upper edge region with a tubular portion 3 is first cut to the length of the intended erected screen plus an extra 300 mm. A rail, hereinafter referred to in the description of this embodiment as a batten, 2, which in this embodiment has engagement means at each end, e.g., a hook 21 at one end and an eye 22 at the other, is positioned inside the tube 3 in such a way, shown in more detail in FIG. 3*a*, that an integral spigot 4 carrying a compression spring 13 is approximately in the centre of an opening 5 in the integral tube 3 but with a surplus 6 of approximately 150 mm of the sheet 1 continuing beyond the end of batten 2 as shown in FIG. 1.

After making sure that an internal section 10 of a telescopic member is withdrawn entirely into an external section 8 and secured by a thumbscrew 9, further sections 7 are installed on top of the member 8 and are pushed together, each section 7 having an upper end of reduced diameter, the upper end of the top section 7 being positioned through the opening 5 of the tube 3 and engaged into the integral spigot 4. The batten 2 and the support members 7, 8 and 10 are then raised until the batten butts against the ceiling with its end 2 against a side wall as shown in FIG. 1. Thumbscrew 9 is untightened allowing telescopic section 10 to drop onto the floor. Sections 7 and 8 are pushed hard up against the ceiling which compresses the spring 13, and thumbscrew 9 is retightened. The pressure of compressed spring 13 will keep the batten 2 and sections 7, 8 and 10 rigidly in place without further mechanical attachments.

Figure 3A:
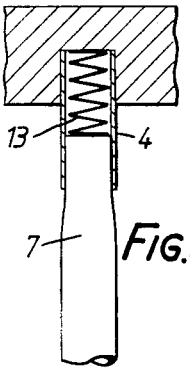
FIG. 3*a* shows a cut away view of part of the upper portion of the screen, showing one form of resilient biasing means.
Figure 3B:
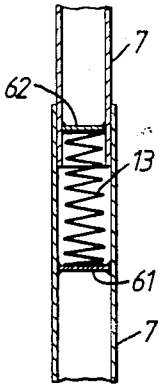
FIG. 3*b* shows another form of resilient biasing means.
Figure 4:
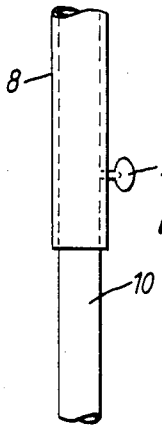
FIG. 4 shows a portion of the support means.

A further location for the biasing means, e.g., the compression spring 13, is illustrated in FIG. 3*b*, in which one end portion 61 of the spring is fixedly mounted on an interior surface of one section 7 of a telescopic member, at a location spaced from an end of the section 7, the other end portion 62 of the spring being fixedly mounted within the interior of another section 7 of the telescopic member.

Another batten similar to the first batten 2 is then positioned within the tube 3 with one end close, preferably adjacent, to an end of the first batten, and in this embodiment, in which interengagement means are present, its end carrying the interengagement means (hook) 21 adjacent to that (the eye) 22 of the first batten 2 and the hook and eye are engaged. The procedure adopted with sections 7, 8, 9, 10, of the first support means is repeated.

Further battens and leg sections are positioned within the tube 3 until the screen is fully in position across the desired length. If necessary the last frame section may be offset as shown in FIG. 1 to allow for any difference between the length of screen required and the predetermined length of the batten.

In the presently preferred embodiments, in which each upper batten forms one of a pair of top and bottom battens, the following procedure is then adopted. It will of course be appreciated that in less preferred embodiments the bottom set of rails, i.e., the lower rail of each pair, is omitted.

Starting from the first support means assembled, the thumbscrew 9 is released and the leg section 10 is pushed back into the leg section 8. The bottom surplus of the sheet is brought forward and under the leg section 10. A batten 11 is positioned on the bottom surplus of the screen, and the leg section 10 is allowed to drop into a hole 12 in the batten 11. The sections 7 and 8 and the batten 2 are pushed hard against the ceiling and thumbscrew 9 is retightened. In this way the sheet 1 is now fixed at the ceiling and floor, with any desired extent of tautness. The procedure is now repeated with the lower battens 11 along the entire length of the screen, the hooks and eyes on these, if present, being interengaged in the same way as those on the battens at the upper edge of the sheet.

To dismantle the screen the steps described above are carried out in reverse order.

Figure 5:
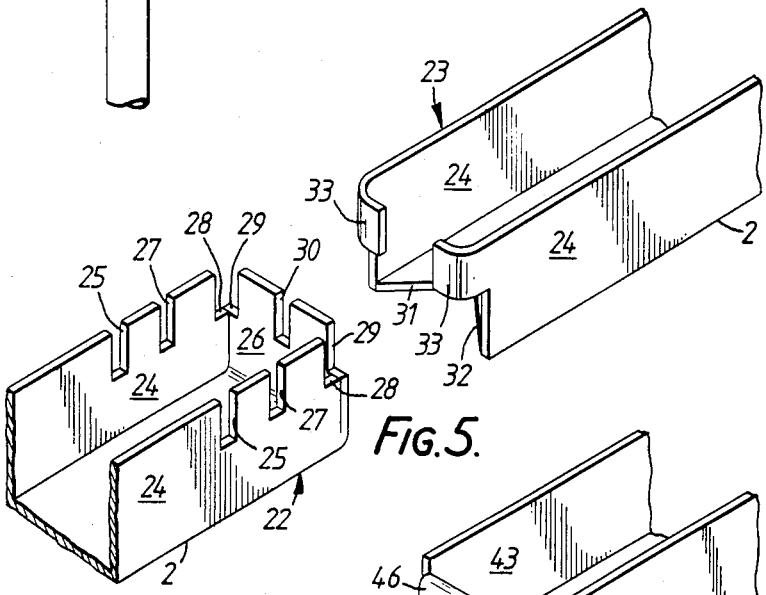
FIG. 5 shows a first form of interengagement means.

Referring now more especially to FIG. 5, there are illustrated a first end, indicated generally by the reference numeral 22, of a first batten 2 and a second end, indicated generally by the reference numeral 23, of a second batten 2. At the first end 22, the side walls 24, 24, are provided with slots 25, 25, extending down from the top surfaces of the walls to approximately half their height. The slots 25 are rather wider than the wall thickness, and spaced a distance from the end wall 26 approximately equal to the width of the batten 2. Similar slots 27, 27, are formed in the side walls 24 a distance approximately half the width of the batten from the end wall 26, and at the end of each of the side walls, 24, 24, approximately the upper half is cut away at 28, 28. The end wall 26 is similarly cut away at its extremities 29, 29, and it is provided with a central slot 30.

Referring now to the end 23 of the second batten 2, the bottom wall 31 terminates in a V-shaped notch 32 and the upper portions of the side walls 24, 24, are extended and curved inwardly to form part end walls 33, 33.

To form a collinear joint between the battens, the end walls 33, 33 are looped over the end wall 26, while to form a right angle joint they are positioned in one slot 25 and over a cut away portion 28. For a 135° joint, the end walls 33, 33 are positioned in the central slot 30 and a slot 27 in one side wall 24 of the first batten 2. The widths of the slots 25 and 27 are such as to allow the ends 22 and 23 to be adjusted within a range of angles sufficient to allow substantially all possible orientations.

Figure 6:
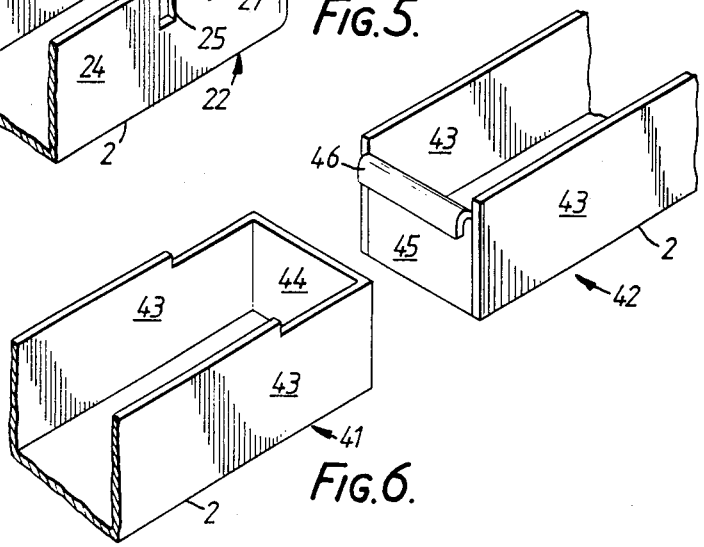
FIG. 6 shows a second form of interengagement means.

Referring now more especially to FIG. 6, there are illustrated a first end portion, indicated generally by the reference numeral 41, of a first batten 2 and a second end portion, indicated generally by the reference numeral 42, of a second batten. At the end 41, the side walls 43, 43 are reduced in height relative to that in the remainder of their lengths, and the end wall is of that reduced height also. At the ends 42, the side walls 43, 43, are of full height, and the upper portion of the end wall 45 is peened over outwardly so that the resulting curved tongue 46 may interengage with the upper surface of the end wall 44.

Figure 7:
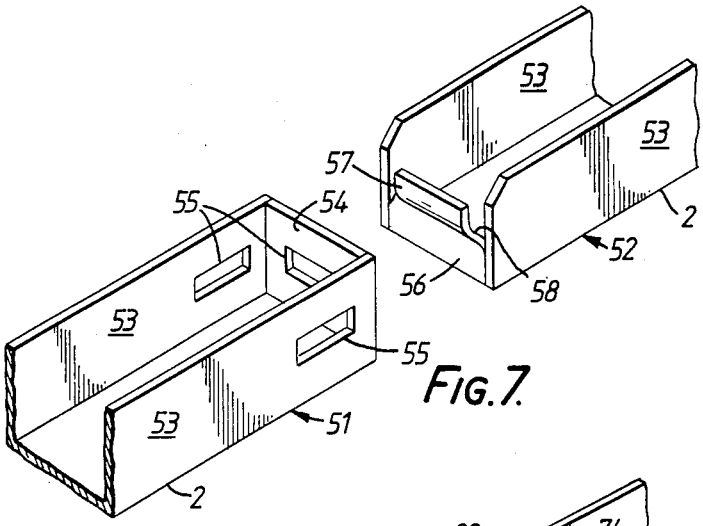
FIG. 7 shows a third form of interengagement means.

Referring now more especially to FIG. 7, there are illustrated a first end portion, indicated generally by the reference numeral 51, of a first batten 2 and a second end portion, indicated generally by the reference numeral 52, of a second batten 2. At the end 51, the side walls 53, 53, and the end wall 54 are each provided with a horizontal slot 55 in their upper portions, of length somewhat less than the width of the end wall. At the end 52, the end wall 56 extends the full width of the space between the side walls 53, 53, for its lower portion, but its upper portion forms a tongue 57, having a reduced width and which curves outward at its base 58 so that it is outwardly offset with respect to the lower portion. The resulting projecting tongue 57 may then interengage with a groove 55 of another batten 2.

Figure 8:
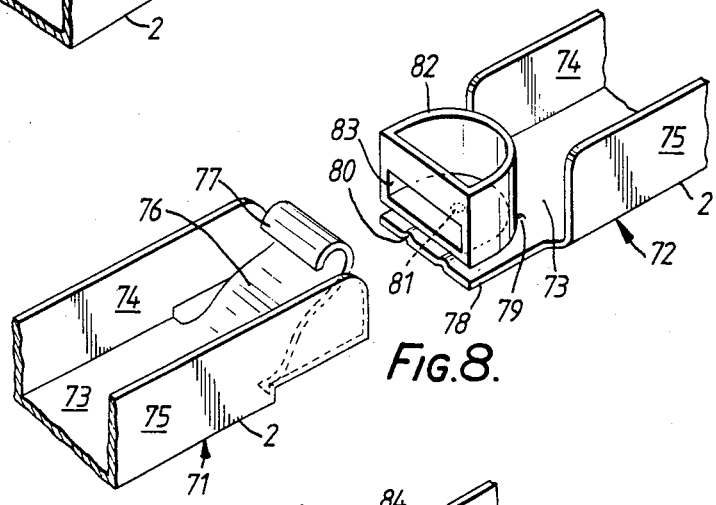
FIG. 8 shows a fourth form of interengagement means.

Referring now more especially to FIG. 8, there are illustrated a first end portion, indicated generally by the reference numeral 71, of a first batten 2, and a second end portion, indicated generally by the reference numeral 72, of a second batten 2. Each batten 2 comprises a bottom wall 73 and side walls 74, 75. At the end 71, the portion of the bottom wall 73 adjoining the side walls 74, 75 is cut away, and the remaining central portion 76 of the end of the bottom wall is formed into an upward sloping tongue curving over approximately at the height of the side walls 74, 75, into a downwardly inturned tip 77. At the second end portion 72, the side walls 74, 75 are removed, together with adjoining outer portions of the bottom wall 73 to leave a tab 78, provided with upwardly projecting longitudinal ribs 79, 80. Mounted on the tab 78 by a rivet 81 loose enough to permit rotation is a D-shaped cup 82 having a horizontal slot 83 cut in the flat wall of the D. The ribs 79, 80, serve not only to strengthen and add rigidity to the tab 78 but also to hinder free rotation of the cup 82 about its loose rivet support 81. This ensures that, while the cup 82 cannot rotate freely to prevent the slot 83 being correctly oriented for engagement when the tongue 76 on the end of a second batten is presented collinearly, rotation of the cup 82 is possible against the frictional forces provided by the ribs 79, 80, when the cup is turned by a tongue 76 of a second batten in engagement with the slot 83.

Figure 9:
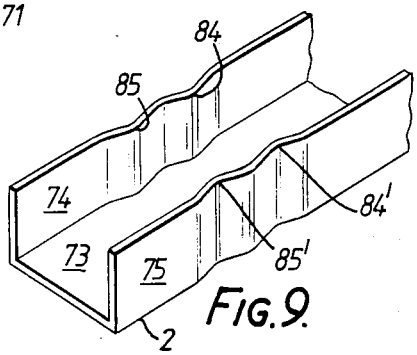
FIG. 9 shows a rail shaped to retain the support means therein.

Referring now more especially to FIG. 9, there is illustrated a mid-section of a batten 2 having a bottom wall 73 and side walls 74, 75. The side walls have been deformed so that the spacing between them is reduced at points 84, 84' and 85, 85', so that the wall 74, between the points 84 and 85, and the wall 75, between the points 84' and 85', describe arcs of a circle of a diameter equal to or slightly greater than the outside diameter of a section 7, 8, or 10. Such a section of the support member may be located within the batten and retained by the wall sections between points 84, 84' and 85, 85'.

Figure 10:
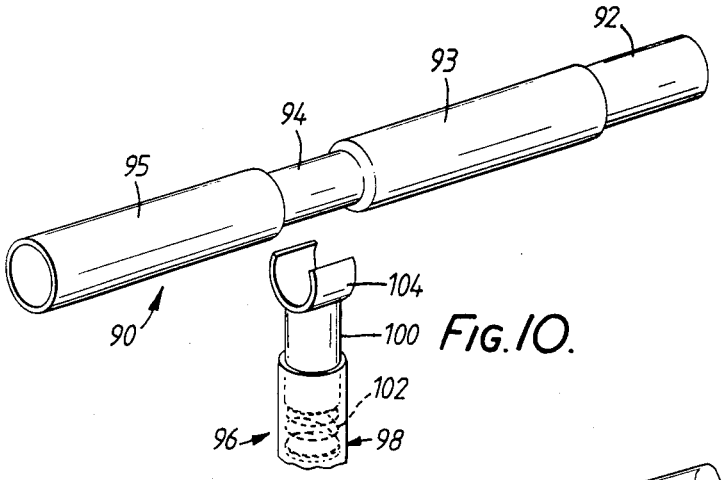
FIG. 10 shows a rail shaped to interengage both with another rail and a support means, and a complementary form of support means.

Referring now to FIG. 10, there is shown a tubular batten indicated generally by the reference numeral 90, which is provided with an end portion 92 and a central portion 94 of reduced diameter compared with that of the remaining portions 93 and 95. A support member indicated generally by the reference numeral 96, of which the upper section only is shown, comprises a first tubular member 98, within which is mounted a tubular stub member 100, linked to it by a compression spring 102, substantially as described with reference to the spring 13 in FIG. 3*b*. At the upper end of the stub member 100 is located a partcircular spring clip 104, which is dimensioned so as to snap fit readily about the portion 94 of the batten 90 but not to slide onto the portions 93 and 95 of the batten 90. The portion 92 of the batten 90 is dimensioned to fit within the portion 95 of a similar batten.

Figure 11:
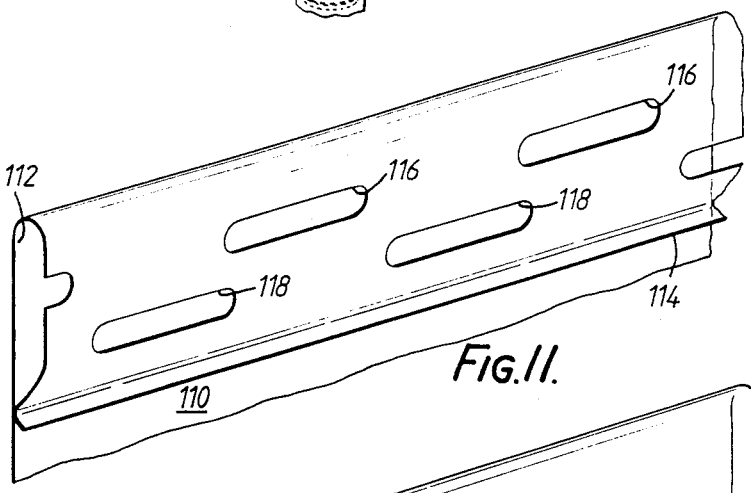
FIGS. 11 and 12 show further forms of sheet constructed in accordance with the invention.

Referring now to FIG. 11, a sheet indicated generally by the reference numeral 110 is provided with a tubular portion 112 at one edge region by means of a weld 114. A first row of elongate apertures 116 spaced apart at a distance approximately equal to the length of the apertures is provided in staggered relation to a second row of similar and similarly spaced apertures 118, with the result that a support member may enter the tube at virtually any location along its length. In order to minimize the risk of tearing the sheet 110, the apertures 116 and 118 advantageously have rounded edges, and are desirably heat punched or stamped out from the sheet 110.

Figure 12:
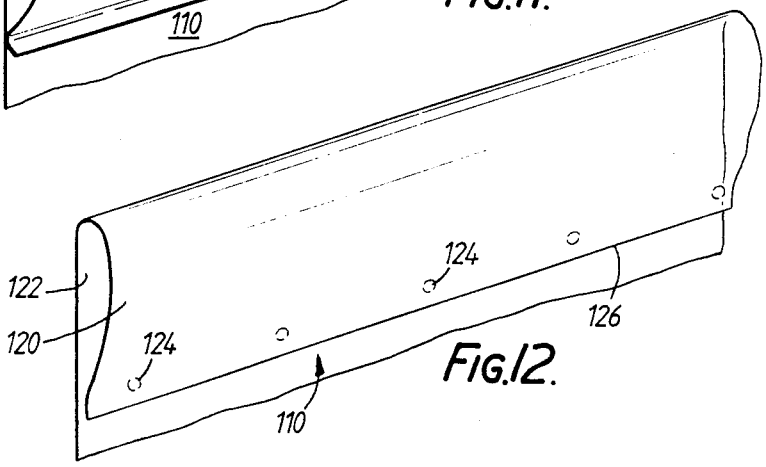

Referring now to FIG. 12, an edge region 120 of a sheet indicated generally by the reference numeral 110 is folded over to form a tubular portion 122, spot welds 124 being provided at spaced intervals in a line close to the edge 126 proper. The individual weld areas are advantageously substantially circular and of sufficient diameter to avoid localized stresses in the material of the sheet close to them. In this embodiment also a support member may enter the tube at virtually any location along its length.

In these and other embodiments of the sheet according to and for use in the present invention, the material used is advantageously an ethylenic polymer, preferably polyethylene, and is advantageously of 1000 gauge. It has been found that material of such thicknesses combines the strength necessary to resist tearing during installation and use while providing the flexibility required for on-site installation by a person working alone.

What I claim is:

1. A screen extending between first and second spaced apart surfaces and comprising a sheet of flexible material, at least one pair of rails and at least one support means, each pair of rails having at least one said support means positioned between the rails of each pair and resiliently urging them apart, the sheet of flexible material extending between the surfaces with a first portion of the sheet being retained between the first surface and one rail and a second portion of the sheet being retained between the second surface and the other rail of each pair of rails.

2. A screen extending between first and second spaced apart surfaces and comprising a sheet of flexible material, a plurality of pairs of rails, and support means, each said pair of rails having support means positioned between them and resiliently urging them apart, the sheet of flexible material extending between the surfaces with a first portion of the sheet being retained between the first surface and one rail and a second portion of the sheet being retained between the second surface and the other rail of each said pair of rails, one edge region of the said sheet being formed into a rail-receiving tube provided with apertures through which the said support means pass.

3. A screen extending between first and second spaced apart surfaces and comprising a sheet of flexible material, a plurality of pairs of rails, and support means, each said pair of rails having support means positioned between them and resiliently urging them apart, the sheet of flexible material extending between the surfaces with a first portion of the sheet being retained between the first surface and one rail and a second portion of the sheet being retained between the second surface and the other rail of each said pair of rails, the said rails being in the form of a trough the side walls of which are shaped to provide socket means for receiving and retaining an end of the support means.

4. A screen extending between first and second spaced apart surfaces and comprising a sheet of flexible material, a plurality of pairs of rails, and support means, each said pair of rails having support means positioned between them and resiliently urging them apart, the sheet of flexible material extending between the surfaces with a first portion of the sheet being retained between the first surface and one rail and a second portion of the sheet being retained between the second surface and the other rail of each said pair of rails, the rails retaining the sheet between them and at least one surface being pivotally interengaged to allow pivotal movement about an axis perpendicular to the surface.

5. A screen extending between spaced apart surfaces and comprising a sheet of flexible material, at least two interengaged rails and at least two support means each resiliently urging a rail toward a surface, the sheet of flexible material extending between the surfaces with a first portion of the sheet being retained between a first surface and the rails and a second portion of the sheet being retained between a second surface and the support means.

6. A method of installing a screen, which comprises positioning a first edge region of a flexible sheet between first rails and a first surface, positioning support means to engage the first rails and a second surface and causing the support means to press the first rails toward the first surface to engage the first edge region between the first rails and the first surface, disengaging the support means from the second surface, positioning a second edge region of the sheet and second rails between the second surface and the support means with the second rails between the support means and the second edge region, and causing the support means to press the second rails toward the second surface to engage the sheet therebetween.

7. A sheet for use in a screen extending between first and second spaced apart surfaces and comprising a sheet of flexible material, a plurality of pairs of rails, and a plurality of support means, each said pair of rails having support means positioned between them and resiliently urging them apart, the sheet of flexible material extending between the surfaces with a first portion of the sheet being retained between the first surface and one rail and a second portion of the sheet being retained between the second surface and the other rail of each pair of rails, a first edge region of the said sheet being formed into a rail-receiving tubular portion, the tubular portion having spaced apertures therein through which support means may enter to engage a rail.

8. A sheet as claimed in claim 7, wherein the tubular portion is formed by bonding along a line parallel to the edge two linear spaced apart zones of the sheet inthe edge region, the bonding being in the form of spot bonds, the spaces between the spot bonds forming the spaced apertures.

9. A screen extending between first and second spaced apart surfaces and comprising a sheet of flexible material, a plurality of pairs of rails, and a plurality of support means, each said pair of rails having support means positioned between them and resiliently urging them apart, the sheet of flexible material extending between the surfaces with a first portion of the sheet being retained between the first surface and one rail and a second portion of the sheet being retained between the second surface and the other rail of each said pair of rails.

10. A method of installing a screen, which comprises positioning a first edge region of a flexible sheet between first rails and a first surface, positioning support means to engage the first rails and a second surface and causing the support means to press the first rails toward the first surface to engage the first edge region between the first rails and the first surface, disengaging the support means from the second surface, positioning a second edge region of the sheet and second rails between the second surface and the support means with the second rails between the support means and the second edge region, and causing the support means to press the second rails toward the second surface to engage the sheet therebetween, the first edge region of said sheet being formed into a rail-receiving tubular portion, the tubular portion having spaced apertures therein through which the support means enter to engage the first rails.

11. A screen as claimed in claim 1, which comprises a least two said pairs of rails.

12. A screen as claimed in claim 1, wherein each rail is provided with a socket for receiving an end of the support means.

13. A screen as claimed in claim 9, having support means comprising length-extending bias means.

14. A screen as claimed in claim 9, wherein the support means comprises at least one pair of telescopically engageable portions.

15. A screen as claimed in claim 9, wherein the support means is provided between the or at least one pair of engageable portions with means for resiliently urging the portions apart.

16. A screen as claimed in claim 10, wherein the means for urging the portions apart is a compression spring.

17. A screen as claimed in claim 9, wherein the support means is provided with means for varying its length and maintaining it at a desired length.

18. A screen as claimed in claim 1, wherein the first and second surfaces are a floor and a ceiling.

* * * * *